US007409915B2

(12) United States Patent
Hagar

(10) Patent No.: US 7,409,915 B2
(45) Date of Patent: Aug. 12, 2008

(54) BEACH LOCK APPARATUS

(76) Inventor: Jay W. Hagar, 757 SE. 17th St., Ft. Lauderdale, FL (US) 33316

( * ) Notice: Subject to any disclaimer, the term of this patent is extended or adjusted under 35 U.S.C. 154(b) by 0 days.

(21) Appl. No.: 11/516,437

(22) Filed: Sep. 6, 2006

(65) Prior Publication Data

US 2008/0053346 A1 Mar. 6, 2008

(51) Int. Cl.
*E05G 1/00* (2006.01)

(52) U.S. Cl. ..... 109/50; 70/63; 70/164; 70/DIG. 57; 109/51; 109/52; 248/552

(58) Field of Classification Search ..... 70/63, 70/229–232, 158, 163–173, DIG. 57; 109/23, 109/50–52; 248/156, 530, 545, 910, 551–553; 52/157, 165; 135/16, 96, 98, 119, 34.2, 124, 135/99; 220/315, 328
See application file for complete search history.

(56) References Cited

U.S. PATENT DOCUMENTS 1,222,739 A * 4/1917 Chime ..... 248/158
1,959,291 A * 5/1934 Millice ..... 109/51
4,072,286 A * 2/1978 Foncannon ..... 248/154
4,444,031 A * 4/1984 Watson ..... 70/232
4,454,824 A * 6/1984 Wood ..... 109/52
4,626,616 A * 12/1986 Masters ..... 174/37
4,664,041 A * 5/1987 Wood ..... 109/51
5,027,626 A * 7/1991 Appelbaum ..... 70/164
5,235,920 A * 8/1993 Hector ..... 109/51
5,375,440 A * 12/1994 Patterson ..... 70/63
5,649,437 A * 7/1997 Royka et al. ..... 70/164
6,082,157 A * 7/2000 Boyce ..... 70/58
6,554,012 B2 * 4/2003 Patarra ..... 135/16
2006/0060749 A1 * 3/2006 Dahlstrom ..... 248/545

* cited by examiner

*Primary Examiner*—Lloyd A Gall
(74) *Attorney, Agent, or Firm*—Oltman, Flynn & Kubler

(57) ABSTRACT

An item locking apparatus for releasibly anchoring personal items to beach sand includes an auger having an upright auger shaft with a shaft lower end and a shaft upper end and a ramped auger screw flange below the shaft upper end for screwing into beach sand; a lug structure fixedly secured to the shaft upper end; a locking post extending upwardly from and free spinning relative to the lug structure and having a padlock engaging structure through which a padlock bolt can pass; a shield disk having a central disk port through which the auger shaft upper end passes so that the shield disk is rotatably mounted immediately below and is retained by the lug structure and a free spinning shield dome lockingly covering the lug structure having a dome port through which the post extends upwardly, so that the shield disk and shield dome spin freely around the auger shaft and prevent unauthorized persons from gripping and rotating the auger shaft.

7 Claims, 2 Drawing Sheets

BEACH LOCK APPARATUS

BACKGROUND OF THE INVENTION

1. Field of the Invention

The present invention relates generally to the field of personal items securing and locking devices. More specifically the present invention relates to an item lock apparatus for releasibly anchoring items to beach sand while the owner is swimming, picnicking or is otherwise occupied. The apparatus includes an auger having an upright auger shaft and a ramped auger screw flange at the shaft lower end for screwing into beach sand, and a lug structure preferably in the form of a lug box fixedly secured to the shaft upper end. A locking post extends upwardly from the lug structure, preferably in the form of a free spinning rod having a retaining flange at the rod lower end inside the lug box and has a lock engaging structure in the form of a post diametric bore through which a padlock bolt can pass. A shield disk having a central disk port is fitted over the auger shaft upper end so that the shield disk is rotatably mounted immediately below and is retained from above by the lug structure, the shield disk preferably having a disk stabilizing tube encompassing the disk port and the auger shaft and secured to the shield disk to extend downwardly from the shield disk, so that the shield disk and disk mounting tube spin freely around the auger shaft, and obstruct access to the auger shaft to prevent others from gripping and rotating the auger shaft, a shield dome having a dome apex port for fitting over the lug structure and around the locking post to a level below the post diametric bore to spin freely about the auger shaft and so that a padlock bolt can be fitted through the post diametric bore and locked above the shield dome so that the shield dome encloses and prevents unauthorized access to the lug structure, so that personal items can be lockingly secured to the padlock and unauthorized persons have access only to the free spinning post, dome and shield disk and thus cannot engage and rotate the auger shaft to remove the apparatus and steal the engaged items. It is contemplated that the apparatus be used to anchor a cooler box or other container to the beach sand to provide a secure dry compartment for items. A lug engaging lever structure is provided preferably in the form of a lug wrench sized and configured to engage the lug structure for rotating the auger shaft to screw the lock apparatus into and out of the beach sand.

2. Description of the Prior Art

People have long brought personal items such as rings, watches and other items to the beach, only to have to remove them before entering the water. Often these items are secured in an automobile, but where beach parking is a long walk from the beach this is not always convenient. Where items are brought to the beach, the only way to secure the items typically would be to hide them such as underneath a beach towel, a strategy fully understood by potential thieves.

It is thus an object of the present invention to provide a beach lock for securing personal items and other possessions to the beach itself.

It is another object of the present invention to provide such a beach lock which is easily and quickly anchored in beach sand and just as quickly and easily removed by the owner of the items to be secured, and yet which is extremely difficult for a thief to dislodge without attracting attention.

It is still another object of the present invention to provide such a beach lock which is light weight and compact so that it can be carried and stored easily.

It is finally an object of the present invention to provide such a beach lock which is sturdy, reliable and inexpensive to manufacture.

SUMMARY OF THE INVENTION

The present invention accomplishes the above-stated objectives, as well as others, as may be determined by a fair reading and interpretation of the entire specification.

An item lock apparatus is provided for releasibly anchoring personal items to beach sand, the apparatus including an auger having an upright auger shaft with a shaft lower end and a shaft upper end and a ramped auger screw flange below the shaft upper end for screwing into and out of beach sand; a lug structure fixedly secured to the shaft upper end; a locking post extending upwardly from the lug structure and having a padlock engaging structure through which a padlock bolt can pass; a shield disk having a central disk port through which the auger shaft upper end passes so that the shield disk is rotatably mounted immediately below and is retained by the lug structure, so that the shield disk spins freely around the auger shaft, and obstructs access to the auger shaft to prevent unauthorized persons from gripping and rotating the auger shaft;

a shield dome having a dome apex port for removably fitting over the lug structure and around the locking post to a level below to spin freely about the auger shaft and so that a padlock bolt can be engaged by the padlock engaging structure and locked above the shield dome while the shield dome encloses and prevents unauthorized access to the lug structure; and a lug engaging lever structure sized and configured to engage the lug structure for gripping to rotate the auger shaft to screw the auger shaft into and out of beach sand; so that items can be lockingly secured to the padlock and unauthorized persons have access only to the free spinning the post, dome and shield disk and thus cannot engage and rotate the auger shaft to remove the apparatus and steal any engaged items.

The shield disk preferably includes a disk stabilizing tube encompassing the disk port and the auger shaft and secured to the shield disk to extend downwardly from the shield disk. The item lock apparatus preferably additionally includes a container having a container bottom wall with a container port, where the auger shaft passes through the container port so that the shield disk is immediately below and the lug structure is above the container bottom wall and the lug structure and the shield dome secure the container to the apparatus and the apparatus secures the container to the beach. The lug structure preferably includes a lug box. The lug engaging lever structure preferably takes the form of a lug wrench. The locking post preferably includes a free spinning rod having a rod lower end and a retaining flange at the rod lower end inside the lug box. The padlock engaging structure preferably takes the form of a post diametric bore through the locking post.

An item lock apparatus for releasibly anchoring personal items to beach sand is further provided, including an auger having an upright auger shaft with a shaft lower end and a shaft upper end and a ramped auger screw flange means below the shaft upper end for screwing into beach sand; a lug structure fixedly secured to the shaft upper end; a locking mechanism at the shaft upper end for securing personal items; and a shield structure covering the lug structure rotatably mounted to the apparatus to be free spinning relative to the lug structure and auger.

BRIEF DESCRIPTION OF THE DRAWINGS

Various other objects, advantages, and features of the invention will become apparent to those skilled in the art from the following discussion taken in conjunction with the following drawings, in which.

DETAILED DESCRIPTION OF THE PREFERRED EMBODIMENTS

Figure 1:
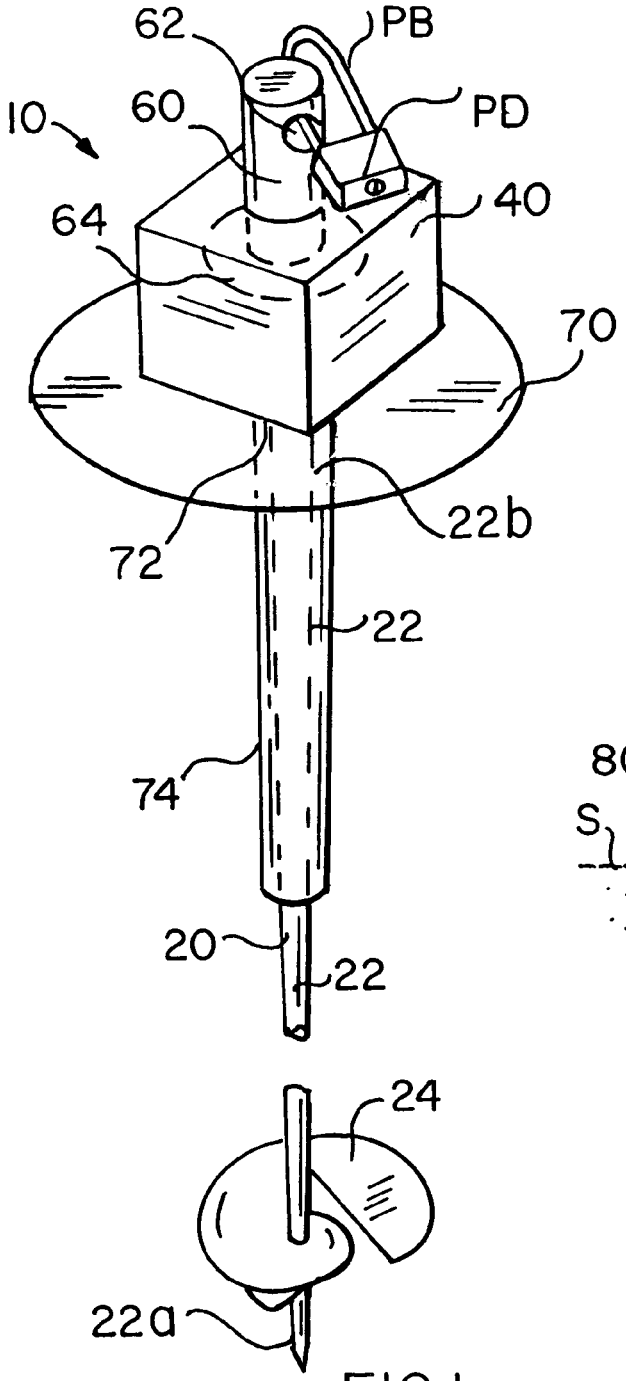
FIG. 1 is a perspective view of the preferred embodiment of the beach lock apparatus with a segment of the auger shaft broken away and the shield dome removed to expose the lug structure and, locking post and padlock.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Reference is now made to the drawings, wherein like characteristics and features of the present invention shown in the various FIGURES are designated by the same reference numerals.

First Preferred Embodiment

Figure 2:
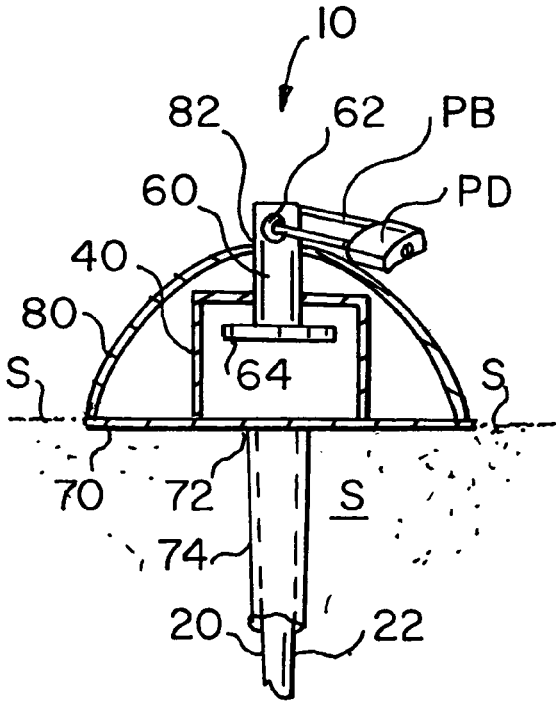
FIG. 2 is a cross-sectional side view of the beach lock of FIG. 1 showing the post retaining flange and showing the shield dome secured in place.
Figure 3:
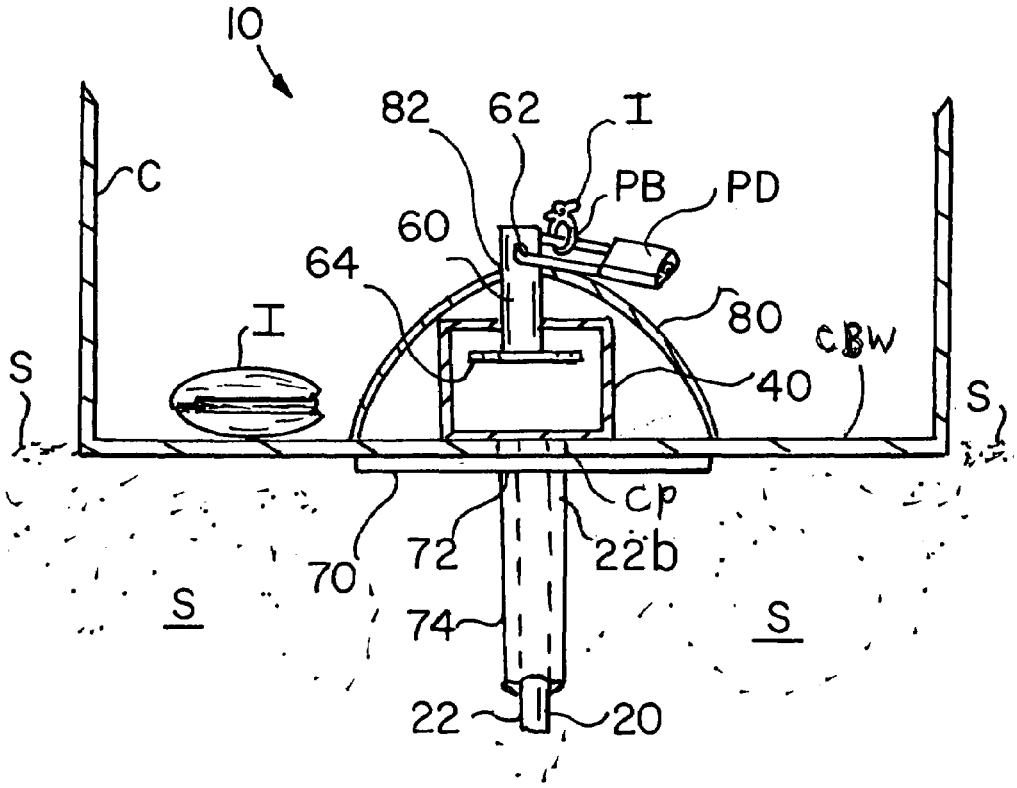
FIG. 3 is a view as in FIG. 2 except that a container, preferably with a locking lid, is secured by the beach lock in which items can be stored.
Figure 4:
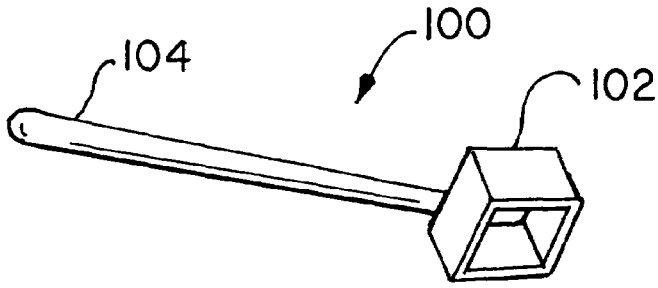
FIG. 4 is a perspective view of a preferred lug engaging lever structure having an open bottom box which fits engagingly over the lug box for rotating the lug box and auger to screw the auger into and out of beach sand. A ring is shown engaged by the padlock and a wallet is shown inside the container.

Referring to FIGS. 1-4, an item lock apparatus 10 is disclosed for releasibly anchoring personal items I to beach sand while the owner is swimming, picnicking or is otherwise occupied. Apparatus 10 includes an auger 20 having an upright auger shaft 22 and a ramped auger screw flange 24 at the shaft lower end 22*a* for screwing into beach sand S and a lug structure 40 fixedly secured to the shaft upper end 22*b*. A locking post 60 extends upwardly from the lug structure 40 and has a lock engaging structure 62 in the form of a post diametric bore 62 through which a bolt PB of a padlock PD can pass. A shield disk 70 having a central disk port 72 is fitted over the auger shaft 22 and slid to the auger shaft upper end 22*b* so that the shield disk 70 is rotatably mounted immediately below and is retained from above by the lug structure 40, the shield disk 70 preferably having a disk stabilizing tube 74 encompassing the disk port 72 and rotatably fitted around the auger shaft 22 and secured to the shield disk 70 to extend downwardly from the shield disk 70. Thus the shield disk 70 and disk mounting tube 74 spin freely around the auger shaft 22, and obstruct access to the auger shaft 22 when the apparatus 10 is embedded in beach sand S to prevent others from gripping and rotating the auger shaft 22. A shield dome 80 is provided having a dome concave face directed downwardly for fitting over the lug structure 40 and having a dome apex port 82 and around the locking post 60 to a level below the post diametric bore 62 to spin freely about the auger shaft 22. A padlock bolt PB is fitted through the post diameter bore 62 and locked above the shield dome 80 so that the shield dome 80 encloses and prevents unauthorized access to the lug structure 40. As a result, items I can be lockingly secured to the padlock PD and unauthorized persons have access only to the free spinning post 60, shield dome 80 and shield disk 70, and thus cannot engage and rotate the auger shaft 22 to remove apparatus 10 and steal the engaged items. A lug engaging lever structure 100 having a lug structure engaging box 102 sized and configured to engage the lug structure 40 and a lever handle 104 is provided for rotating the auger shaft 22 to screw the lock apparatus 10 into and out of the beach sand S.

It is contemplated that apparatus 10 be used to anchor a cooler box or other container C to the beach sand S to provide a secure dry compartment for items I. For this application of apparatus 10, the auger shaft 22 passes through a container port CP in the container bottom wall CBW so that the shield disk 70 is immediately below and the lug structure 40 is immediately above the container bottom wall CBW. In this way, the lug structure 40 and the shield dome 80 secure the container C to the apparatus 10, and the apparatus 10 secures the container C to the beach.

Lug structure 40 preferably takes the form of a lug box. Lug engaging lever structure 100 preferably takes the form of a lug wrench. The locking post 60 preferably takes the form of a free spinning rod having a retaining flange 64 at the rod lower end inside the lug box 40.

While the invention has been described, disclosed, illustrated and shown in various terms or certain embodiments or modifications which it has assumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim as my invention:

1. An item lock apparatus for releasibly anchoring personal items to beach sand, comprising:

an auger having an upright auger shaft with a shaft lower end and a shaft upper end and a ramped auger screw flange means below said shaft upper end for screwing into beach sand;

a lug structure fixedly secured to said shaft upper end;

a locking post extending upwardly from said lug structure and having a padlock engaging structure through which a padlock bolt can pass;

a shield disk having a central disk port through which said auger shaft upper end passes such that said shield disk is rotatably mounted immediately below and is retained by said lug structure, such that said shield disk spins freely around said auger shaft, and obstructs access to said auger shaft to prevent unauthorized persons from gripping and rotating said auger shaft;

a shield dome having a dome apex port for removably fitting over said lug structure and around said locking post to spin freely about said auger shaft and such that a padlock bolt can be engaged by said padlock engaging structure and locked above said shield dome while said shield dome encloses and prevents unauthorized access to said lug structure;

and a lug engaging lever structure sized and configured to engage said lug structure for gripping to rotate said auger shaft to screw said auger shaft into and out of beach sand;

such that items can be lockingly secured to the padlock and unauthorized persons have access only to said post, dome and shield disk which spin freely relative to said auger shaft and thus such persons cannot engage and rotate said auger shaft to remove said apparatus and steal any engaged items.

2. The item lock apparatus of claim 1, wherein said shield disk comprises a disk stabilizing tube encompassing said disk port and said auger shaft and secured to said shield disk to extend downwardly from said shield disk.

3. The item lock apparatus of claim 1, additionally comprising a container having a container bottom wall with a container port, wherein said auger shaft passes through said container port such that said shield disk is immediately below and said lug structure is above said container bottom wall and said lug structure and said shield dome secure said container to said apparatus and said apparatus secures said container to the beach.

4. The item lock apparatus of claim 1, wherein said lug structure comprises a lug box.

5. The item lock apparatus of claim 1, wherein said lug engaging lever structure comprises a lug wrench.

6. The item lock apparatus of claim 4, wherein said locking post comprises a free spinning rod having a rod lower end and a retaining flange at said rod lower end inside said lug box.

7. The item lock apparatus of claim 1, wherein said padlock engaging structure comprises a post diametric bore through said locking post.

* * * * *